US005323160A

United States Patent [19]

Kim et al.

[11] Patent Number: 5,323,160

[45] Date of Patent: Jun. 21, 1994

[54] LAMINATED ELECTROMAGNETIC WAVE ABSORBER

[75] Inventors: Kyung Y. Kim, Seoul; Wang S. Kim, Kyungki-Do; Hyung J. Jung; Hue S. Song, both of Seoul, all of Rep. of Korea

[73] Assignee: Korea Institute of Science and Technology, Seoul, Rep. of Korea

[21] Appl. No.: 915,052

[22] Filed: Jul. 16, 1992

[30] Foreign Application Priority Data

Aug. 13, 1991 [KR] Rep. of Korea ..... 13921/1991

[51] Int. Cl.[5] ..... H01Q 17/00

[52] U.S. Cl. ..... 342/1; 342/3; 342/4

[58] Field of Search ..... 342/1, 2, 3, 4

[56] References Cited

U.S. PATENT DOCUMENTS

| | | | |
|---|---|---|---|
| 3,568,195 | 3/1971 | Wesch et al. | 342/1 |
| 3,662,387 | 5/1972 | Grimes | 342/1 |
| 3,680,107 | 7/1972 | Meinke et al. | 342/1 |
| 3,720,951 | 3/1973 | Naito | 342/1 |
| 3,737,903 | 6/1973 | Suetake et al. | 342/1 |
| 3,754,255 | 8/1973 | Suetake et al. | 342/4 |
| 3,887,920 | 6/1975 | Wright et al. | 342/1 |
| 3,938,152 | 2/1976 | Grimes et al. | 342/1 |
| 4,012,738 | 3/1977 | Wright | 342/1 |
| 4,023,174 | 5/1977 | Wright | 342/4 |
| 4,024,318 | 5/1977 | Forster et al. | 342/1 X |
| 4,116,906 | 9/1978 | Ishino et al. | 260/22 A |
| 4,538,151 | 8/1985 | Hatakeyama et al. | 342/1 |
| 4,814,546 | 3/1989 | Whitney et al. | 174/36 |
| 4,948,922 | 8/1990 | Varadan et al. | 174/35 GC |
| 5,047,296 | 9/1991 | Miltenberger et al. | 428/694 |

FOREIGN PATENT DOCUMENTS

| | | |
|---|---|---|
| 54-27556 | 11/1979 | Japan . |
| 55-5720 | 8/1980 | Japan . |
| 57-34398 | 2/1982 | Japan . |

OTHER PUBLICATIONS

H. Yamashita, et al.; Electromagnetic Wave Absorbing Wall for TV Ghost Suppression; Jap. J. Elec. Comm.; vol. J61-B, No. 8, pp. 729-736 [No Translation].

*Primary Examiner*—John B. Sotomayor

*Attorney, Agent, or Firm*—Scully, Scott, Murphy & Presser

[57] ABSTRACT

Ferrites as an electromagnetic wave absorber have their unique attenuation ranges depending on their compositions. The possibility of controlling attenuation characteristics of ferrite absorber by forming laminates of ferrite is disclosed. This invention provides that the center frequency of laminated ferrites could be changed arbitrarily employing ferrite with different composition and thickness. The method consists of stacking at least two soft ferrite layers (Ni-Zn, Mn-Zn) with various thickness.

1 Claim, 3 Drawing Sheets

LAMINATED ELECTROMAGNETIC WAVE ABSORBER

BACKGROUND OF THE INVENTION

This invention relates to ferrite articles for electromagnetic wave absorbers, which consist of at least two different ferrite layers. The laminated ferrites compared to monolithic ferrites have intentionally controllable frequency ranges which are useful as electromagnetic wave absorber.

With the advancement of communication in information-oriented modern society, various interferences, which are now termed as wave pollutions, are encountered due to unwanted electromagnetic waves. For example, the 'ghost' phenomenon on television sets is caused by the complex reflected waves by tall buildings and malfunctions of electronic equipments are often caused by electromagnetic waves of outside sources. In order to prevent such interferences various modifications of transmitting and receiving method have been considered as a possible solution. (H. Yamashita, et al., "Electromagnetic wave absorbing wall for TV ghost suppression," Jap. J. Elec. Comm., J61-B(8)) However, the fundamental solution for wave interferences is to cut-off all the incoming waves from outside sources. To separate a building from unwanted wave, this would mean cladding the outside of the building with a material capable of absorbing electromagnetic waves.

One of the best known electromagnetic wave absorbers is magnetic material such as ferrites in which incoming electromagnetic waves are attenuated by transforming into heat. The magnetic loss of ferrites thus prevents electromagnetic waves from reflecting.

Basic structure of ferrite electromagnetic wave absorbers consists of a ferrite layer attached to a metal plate which is a reflecting material FIG. 1A. For such a structure the input impedance of front ferrite layer (when normalized as an impedance in free space) becomes $$Z = \frac{Z_{in}}{Z_o} = \sqrt{\frac{\mu_r}{\epsilon_r}} \tanh\left[j\frac{2\pi d}{\lambda}\sqrt{\mu_r\epsilon_r}\right] \quad (1)$$

where $\lambda$, $Z_o$, $\mu_r$, $\epsilon_r$ and d represent the frequency in free space, impedance in free space, permeability, permittivity and the thickness of the ferrite, respectively. In this case, attenuation becomes as follows, $$\text{Attenuation (dB)} = 20\log(|S|) \quad (2)$$

where, $$S = \frac{Z-1}{Z+1}$$

As shown in the above equations the characteristics of ferrite as electromagnetic wave absorbers are determined by the inherent electromagnetic properties of ferrites such as complex permeability and permittivity, which in turn are determined by the composition of ferrites. Moreover ferrite can act as the wave absorber in a narrow frequency range due to its resonance characteristics. The frequency of electromagnetic noises generated by the electronic equipments mostly ranges from 30 MHz to 1 GHz although noise frequency of each equipment is confined to a relatively narrow range. A ferrite with a composition suitable for the purpose should be developed, which is a difficult task.

As the prior methods to change the absorbing frequency range, a method wherein polymers such as a rubber were added to a ferrite has been proposed (U.S. Pat. No. 4,116,906). However, the resulting materials were only useful for noises at X-band. The materials also had various physical and mechanical problems such as degradation and low strength, which were caused by polymers added.

DESCRIPTION OF THE INVENTION

The primary object of the present invention is to provide multi-layered ferrite bodies whose characteristics are known. The layered composites have different characteristics of electromagnetic wave absorption from their constituent ferrites especially for the frequency range of more than 20 dB attenuation, which is a required value for an electromagnetic wave absorber in practice. The frequency range of more than 20 dB attenuation of the laminated ferrite can be further changed by employing the thickness of each layer as a variable.

Figure 1A:
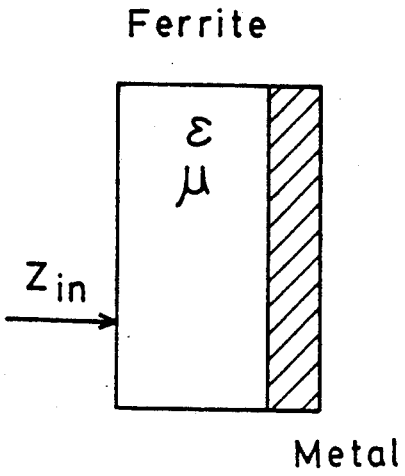
FIGS. 1A and 1B show the basic structure of ferrite electromagnetic wave absorber (FIG. 1A; single-layer type, FIG. 1B; laminated layer type)
Figure 1B:
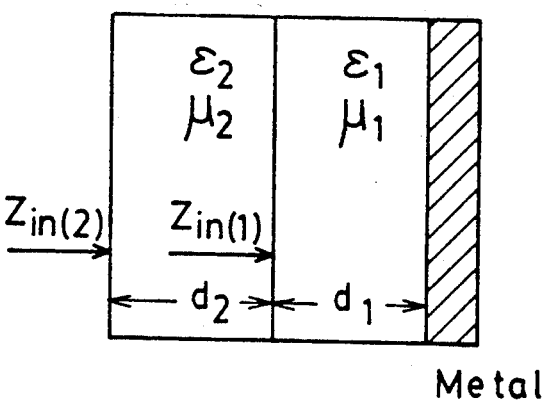

For laminated ferrite (FIG. 1B) input impedance becomes $$Z_{in(2)} = \frac{Z_2\left[Z_{in(1)} + Z_2\cdot\tanh\left[j\frac{2\pi}{\lambda}\sqrt{\mu_{2r}\epsilon_{2r}}\cdot d_2\right]\right]}{Z_2 + Z_{in(1)}\cdot\tanh\left[j\frac{2\pi}{\lambda}\sqrt{\mu_{2r}\epsilon_{2r}}\cdot d_2\right]} \quad (3)$$

$$Z_{in(1)} = \sqrt{\frac{\mu_1}{\epsilon_1}}\cdot\left[\tanh j\frac{2\pi}{\lambda}\sqrt{\mu_{1r}\epsilon_{1r}}\cdot d_1\right]$$

$$Z_2 = \sqrt{\frac{\mu_2}{\epsilon_2}}$$

where $\mu_{1r}$, $\epsilon_{1r}$ and $d_1$ represent the permeability, permittivity and thickness of ferrite which is located near the metal plate, $\mu_{2r}$, $\epsilon_{2r}$ and $d_2$ represent those of ferrite outside. When $[j(2\pi/\lambda)\ \mu\epsilon d]$ is so small, the following condition is valid.

$$\tanh(j(2\pi/2)\sqrt{\mu\epsilon}\ d) \simeq C\sqrt{\mu\epsilon}\ d \quad (4)$$

where, $C = j(2\pi/2)$

Then equation (3) can be approximated as $$Z = Z_{in(2)}/Z_o = \frac{C\mu_{1r}d_1 + C\mu_{2r}d_2}{1 + C^2\mu_{1r}\epsilon_{2r}d_1d_2} \quad (5)$$

Because C value is about $10^{-3}$/mm and $2\times10^{-2}$/mm at 50 MHz and 1 GHz respectively, $C^2\mu_{1r}\epsilon_{2r}d_1d_2$ is also negligibly small. Then the equation (5) is further simplified as $$Z = Z_{in(2)}/Z_o \simeq C\mu_{1r}d_1 + C\mu_{2r}d_2 \quad (6)$$

Right side of equation (6) corresponds to the sum of impedance of each ferrite. Thus, impedance of laminated ferrite would be simultaneously changed by changing the thickness of each ferrite.

In summary, the present invention provides a method for preparing ferrite bodies whose attenuation characteristics can be intentionally changed. The method consists of stacking at least two ferrite layers with various thicknesses.

The following example is offered by way of illustration and not by way of limitation.

EXAMPLE

Figure 2:
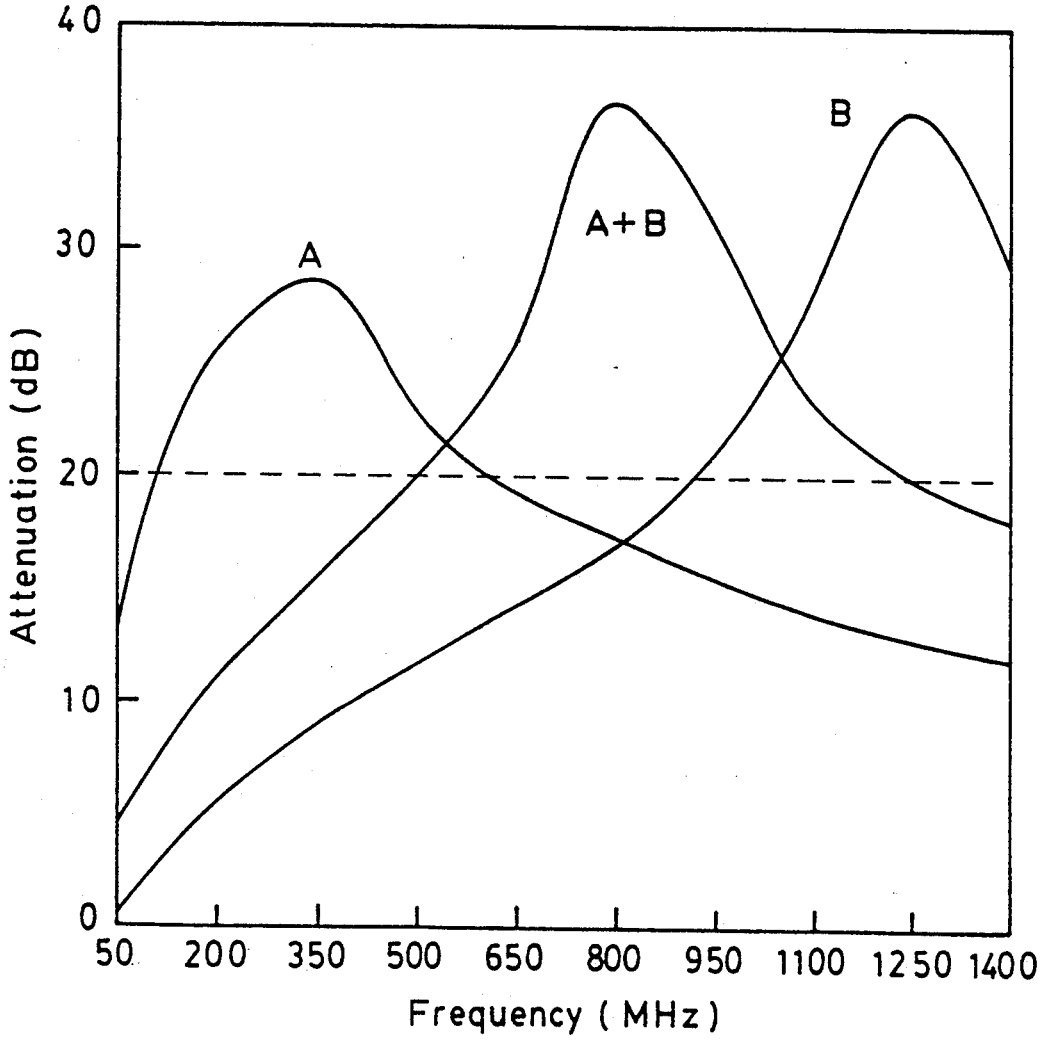
FIG. 2 illustrates the attenuation characteristics of double-layered electromagnetic wave absorber in contrast with those of single-layered electromagnetic wave absorber, in the FIG. 2 represent the attenuation characteristics of Mn-Zn and Ni-Zn ferrites, respectively, whereas A+B corresponds to that of double-layered ferrite (Mn-Zn ferrite 5 mm, Ni-Zn ferrite 3 mm)

A double-layered ferrite was formed from ($Mn_{0.6}Zn_{0.34}Fe_{2.61}O_4$) and ($Ni_{0.3}Zn_{0.7}Fe_2O_4$) whose frequency range of more than 20 dB attenuation is at 100-650 MHz and above 800 MHz, respectively (FIG. 2). It can be seen from FIG. 2 that the frequency range of more than 20 dB attenuation of the composite ferrite is at 200-1,000 MHz.

Figure 3:
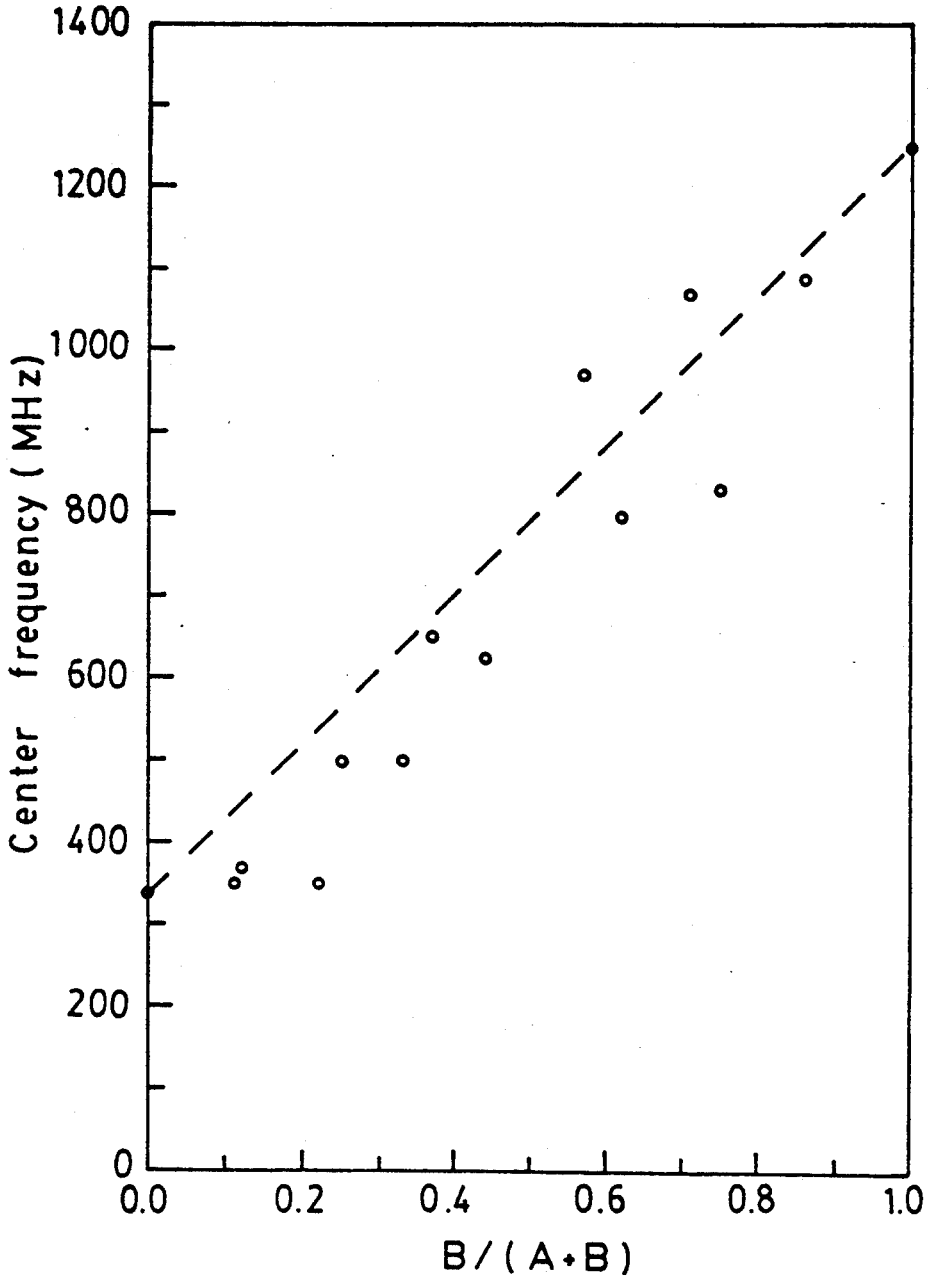
FIG. 3 illustrates the attenuation characteristics of double-layered ferrite electromagnetic wave absorbers as functions of ratio of thickness of Mn-Zn and Ni-Zn Ferrites and total thickness.

For different double-layered ferrites were formed from the same ferrites used in Example. It can be seen from FIG. 3 that the center frequency (Frequency at the maximum point of attenuation curve) of the laminated ferrites can be changed by varying the thickness of constituent layer.

What is claimed is:

1. An electromagnetic wave absorber having a multilayered structure comprising:

(a) at least two electromagnetic wave absorbing materials formed from $Mn_{0.6}Zn_{0.34}Fe_{2.61}O_4$ and $Ni_{0.3}Zn_{0.7}Fe_2O_4$, said materials having different attenuation characteristics and affixed to each other; and (b) a metallic plate having one of the wave absorbing materials affixed thereto, wherein the normalized impedance of the absorbing materially is given substantially by the formula:

$$Z = \frac{C\mu_{1r}d_1 + C\mu_{2r}d_2}{1 + C^2\mu_{1r}\epsilon_{2r}d_1d_2}$$

where $C = j\,(2\pi/\lambda)$ $\lambda$: wavelength in free space $\mu_{1r}$, $\epsilon_{1r}$, $d_1$: permeability, permittivity and thickness of the ferrite located on the metallic plate $\mu_{2r}$, $\epsilon_{2r}$, $d_2$: permeability, permittivity and thickness of the outside ferrite; and wherein the impedance of the electromagnetic wave absorber is controlled by changing the thickness of each of said electromagnetic wave absorbing materials.

* * * * *

UNITED STATES PATENT AND TRADEMARK OFFICE

CERTIFICATE OF CORRECTION

PATENT NO. : 5,323,160

DATED : June 21, 1994

INVENTOR(S) : Kyung Y. Kim, et al.

It is certified that error appears in the above-indentified patent and that said Letters Patent is hereby corrected as shown below:

Column 2, lines 65 & 66: "j(2π/2)"

should read --"j(2π/λ )--

Signed and Sealed this

Twenty-fourth Day of January, 1995

Bruce Lehman

*Attest:*

BRUCE LEHMAN

*Attesting Officer*

*Commissioner of Patents and Trademarks*